US005349712A

United States Patent [19]

Kawashima et al.

[11] Patent Number: 5,349,712

[45] Date of Patent: Sep. 27, 1994

[54] VARIABLE DAMPER FOR BRIDGES AND BRIDGE

[75] Inventors: Kazuhiko Kawashima; Shigeki Unjoh, both of Tsukuba; Hideyuki Shimizu, Fukushima, all of Japan

[73] Assignee: Public Works Research Institute, Ministry of Construction, Tsukuba, Japan

[21] Appl. No.: 970,720

[22] Filed: Nov. 3, 1992

[30] Foreign Application Priority Data

Nov. 7, 1991 [JP] Japan ..... 3-291261

[51] Int. Cl.[5] ..... E01D 19/12

[52] U.S. Cl. ..... 14/73.5; 188/299

[58] Field of Search ..... 14/73.5; 188/297, 299, 188/379

[56] References Cited

U.S. PATENT DOCUMENTS

| | | | |
|---|---|---|---|
| 3,979,787 | 9/1976 | Ahlgren | 14/73.5 |
| 4,648,490 | 3/1987 | Bergloff | 188/297 |
| 4,720,882 | 1/1988 | Gallo | 14/73.5 |
| 4,735,296 | 4/1988 | Pinson | 188/379 |
| 5,011,180 | 4/1991 | Dunwoody | 188/297 X |
| 5,072,801 | 12/1991 | Freymann et al. | 188/379 X |
| 5,174,552 | 12/1992 | Hodgson et al. | 188/299 X |
| 5,263,559 | 11/1993 | Mettner | 188/299 |

FOREIGN PATENT DOCUMENTS

| | | | |
|---|---|---|---|
| 41400 | 9/1965 | Fed. Rep. of Germany | 14/73.5 |
| 1184162 | 7/1959 | France | 14/73.5 |
| 138540 | 10/1981 | Japan | 188/379 |
| 1006565 | 3/1983 | U.S.S.R. | 14/73.5 |

*Primary Examiner*—Timothy V. Eley
*Attorney, Agent, or Firm*—Fulbright & Jaworski

[57] ABSTRACT

This variable damper system for a bridge is installed between a superstructure and a substructure of a bridge and can freely change the damping characteristics so that the inertial force of the superstructure generated in an earthquake will be distributed to the substructure and the vibration will be reduced, and all the functions of a viscous damper/stopper, an energy absorber, and a stopper for preventing excessive response with a shock absorber have been integrated in one unit of this system, so that one unit of this system can perform the same functions as those carried out by a plurality of conventions devices each having an independent function and also a narrow space on the top surface of the substructure of a bridge can be used as it is.

4 Claims, 2 Drawing Sheets

VARIABLE DAMPER FOR BRIDGES AND BRIDGE

TECHNICAL FIELD

This invention relates to a variable damper system for a bridge.

BACKGROUND OF THE INVENTION

A typical damper system for a bridge based on the prior art, which is generally called a viscous damper, is shown in FIG. 1, and in this figure, the numerals 1 and 2 indicate a superstructure and a substructure respectively, and a cylinder 4 filled with a viscous fluid and set in a horizontal direction in a bracket 3 mounted on the superstructure is pivotally supported by a supporting shaft 5, and a tip of the piston lever 6 is pivotally supported by a supporting shaft 7 on the substructure. The viscous damper as described above does not resist to slow movements such as expansion or contraction of the superstructure due to temperature changes or for other reasons, but works as a viscous damper stopper which performs the virtually same role as a fixed support to quick vibrations as those in an earthquake. So in an earthquake, inertial force of the superstructure 1 is distributed to each of the substructures 2 to improve stability of the bridge in an earthquake. Generally, a damping coefficient of the viscous damper as described above is set to a large value exceeding critical damping coefficient.

Furthermore, the viscous damper as described above is used not as a stopper with a small damping coefficient which distribute inertial force, but as an energy absorber which positively absorbs vibration energy of the superstructure 1 for reducing vibration of the superstructure 1 by improving the damping characteristics of the entire structure and also reducing the earthquake force delivered to the substructure 2.

The viscous damper described above distributes inertial force of the superstructure 1 in an earthquake and does not reduce the inertial force of the superstructure 1, while a viscous damper as an energy absorber tries to reduce inertial force generated in an earthquake with its improved damping characteristics and does not try to distribute the inertial force. A damping system having both the function to reduce the inertial force and that to distribute inertial force as described above is required especially for installation in a bridge. However, such a device is not available, so it is necessary to install individual dampers each having the respective function in parallel. However, as a wide space to install a plurality of damping systems each having one of these functions is not available on the top surface of the substructure 2 of a bridge, generally only one unit having either one function is installed sacrificing another function, or a wider space is secured by additional cost to install a plurality of the units, which is a problem to be solved.

This invention was made to solve this problem in the conventional type of the damping system as described above, and its object is to provide a low construction cost variable damper system for a bridge which can achieve the same effects as those realized by a plurality of the conventional units each having an individual function because each unit has functions provided by a viscous damper, an energy absorber, and a stopper for preventing excessive response with a shock absorber and can be installed in a narrow space on the top of the substructure of a bridge without modifying it.

DISCLOSURE OF THE INVENTION

This invention relates to a variable damper system to be installed between a superstructure and a substructure of a bridge, which is characterized in that said damper system can change the damping characteristics so that inertial force of the superstructure will be distributed to the substructures and vibration thereof will be reduced in an earthquake.

In the present invention having the features as described above, the damping characteristics are changed by detecting respective displacement of the superstructure and substructures and also detecting a relative displacement between the superstructure and substructures so that the vibration will be reduced.

BEST MODE FOR CARRYING OUT THE INVENTION

Figure 1:
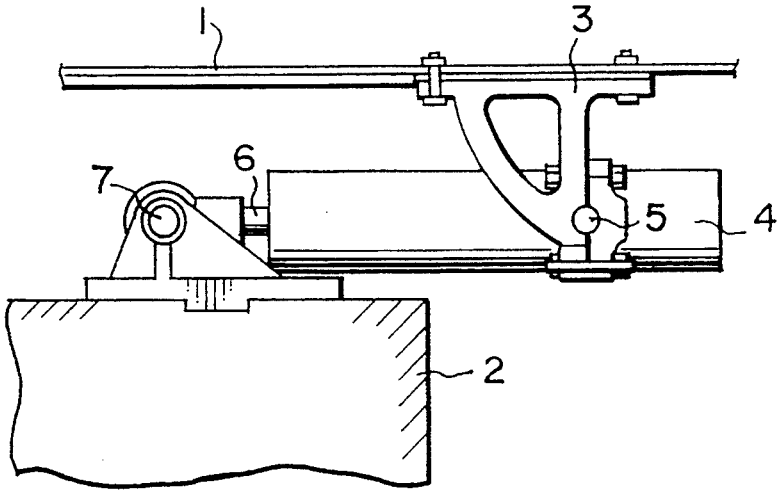
FIG. 1 PRIOR ART
FIG. 1 is a front view of one of the conventional types of system.
Figure 2:
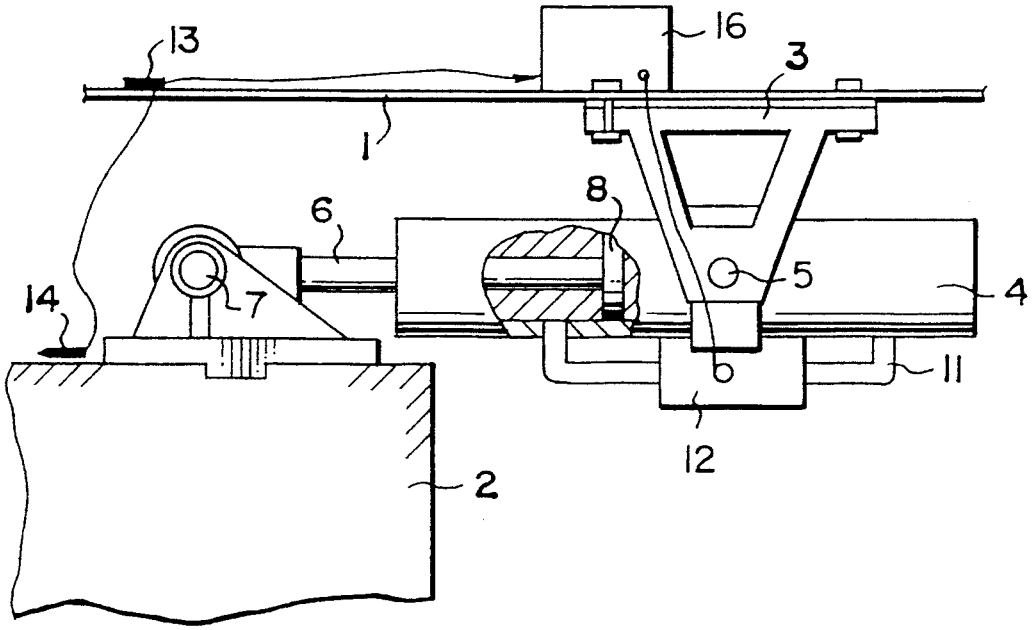
FIG. 2 is a partially lacked front view of an embodiment of this invention.

In the description for embodiment of the present invention shown in FIG. 2, detailed description is made only for different portions from those in the existing damper system and the same numerals are used to portions corresponding to those in the existing damper system to omit detailed descriptions for them. Chambers at both sides of a piston 8 of a cylinder 4 are communicated with a tube 11, a valve unit 12 having a servo valve in which a linear motor is installed in this tube 11, and a first sensor 13 and a second sensor 14 each comprising a displacement sensor or an accelerometer are mounted on superstructure 1 and substructures 2 respectively. These first and second sensors 13 and 14 are connected to a valve controller 16 mounted on the superstructure 1, and this valve controller is connected to the valve unit 12.

Figure 3:
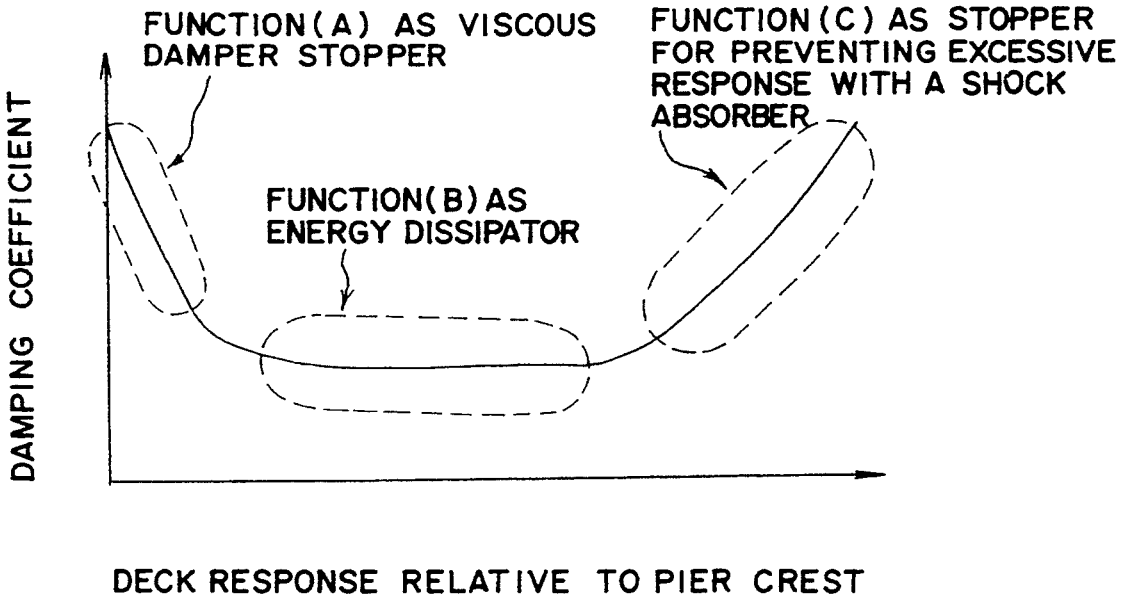
FIG. 3 is a drawing showing a relationship between a damping coefficient of a damper and a deck response relative to pier crest.

In the present invention having the construction as described above, displacement of the superstructure 1 and substructures 2 is detected by the first sensor 13 and sensor 14 respectively, the detected values from sensors 13 and 14 are input into the valve controller, relative displacement between them is computed therein, a voltage corresponding to the relative displacement is outputed from the valve controller 16 to control an opening width of a valve of the valve unit 12, a damping coefficient of the damper is increased as shown in FIG. 3 (A) by controlling the valve unit 12 with the valve controller 16 to reduce the opening width of the value. When an amplitude, namely a displacement response of the superstructure 1 is small, so that the construction can function virtually as a fixed support to braking load such as that in a vehicle and as a movable viscous damper/stopper to expansion and contraction of the superstructure due to slow change of temperature. When an earthquake occurs and an amplitude of vibration, namely a displacement response of the superstructure becomes larger, the construction can work as an energy absorber by increasing an opening width of the valve to reduce a damping coefficient of the damper as shown in FIG. 3 (B) so that the earthquake force transmitted to the substructure 2 can appropriately be reduced. Furthermore, if an amplitude of vibration, namely a displacement response of the superstructure, becomes too large, the construction can function as a stopper with a damping function by gradually reducing the opening width of the valve and increasing the damping coefficient of the damper to suppress further vibration of the superstructure 1 as shown in FIG. C. Thus, with this construction as described above, the vibration of a bridge in an earthquake can be reduced by changing the damping coefficient by changing the opening of the valve. In summary, as the valve opening is narrowed, the damping coefficient is increased and the damper acts as a viscous stopper by reducing the ability of hydraulic fluid to flow from one cylinder to the other. As the valve opening is widened, the damper coefficient is decreased and the damper suppresses vibration by increasing the ability of the hydraulic fluid to flow from one cylinder to the other.

The construction according to the present invention as described above is installed between a superstructure and a substructure of a bridge and can freely change the damping characteristics so that the inertial force of the superstructure generated when an earthquake occurs to the substructure will be distributed and at the same time the vibration will be reduced, and all the functions of a viscous damper/stopper, an energy absorber, and a stopper for preventing excessive response with a shock absorber are integrated in this system, so that it can perform functions carried out by a plurality of units each having an individual function like those in the prior art and a narrow space on the top surface of a substructure of a bridge can be used as it is, which also means a low cost for installation.

We claim:

1. In a bridge having a superstructure and a substructure, a variable system, comprising a damper and means for changing the damping coefficient of the damper in response to vibration of the bridge, the damper attached to the superstructure and substructure of the bridge.

2. A variable system for a bridge comprising:

a piston and a viscous fluid displaced within a cylinder, the piston defining two chambers within the cylinder, the cylinder and the piston oppositely attachable to a superstructure and a substructure of a bridge; and a passageway between the two chambers of the cylinder for the transfer of the fluid between the two chambers; and valve means for altering the size of the passageway.

3. The apparatus of claim 2 further comprising means for detecting displacement of the bridge and means for controlling the valve means.

4. The apparatus of claim 3 in which:

the detecting means further comprises a first sensor displaced on the superstructure and a second sensor displaced on the substructure;

the valve control means further comprises means for ascertaining displacement values from the two sensors, means for determining a desired damping coefficient, and means for outputing to the valve means a voltage corresponding to the desired damping coefficient; and the valve means comprises means for altering the size of the passageway in response to the voltage.

* * * * *

UNITED STATES PATENT AND TRADEMARK OFFICE

CERTIFICATE OF CORRECTION

PATENT NO. : 5,349,712
DATED : September 27, 1994
INVENTOR(S) : K. Kawashima et al It is certified that error appears in the above-indentified patent and that said Letters Patent is hereby corrected as shown below:

Column 2, line 57, "value" should be --valve--.

Signed and Sealed this

Twentieth Day of December, 1994

*Attest:*

Bruce Lehman

BRUCE LEHMAN

*Attesting Officer*

*Commissioner of Patents and Trademarks*